US009318851B2

(12) United States Patent
Ishikawa

(10) Patent No.: US 9,318,851 B2
(45) Date of Patent: Apr. 19, 2016

(54) CONNECTOR AND MANUFACTURING METHOD THEREOF

(71) Applicant: FUJITSU LIMITED, Kawasaki-shi, Kanagawa (JP)

(72) Inventor: Koji Ishikawa, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 21 days.

(21) Appl. No.: 14/446,504

(22) Filed: Jul. 30, 2014

(65) Prior Publication Data

US 2015/0064971 A1 Mar. 5, 2015

(30) Foreign Application Priority Data

Aug. 30, 2013 (JP) ..... 2013-179690

(51) Int. Cl.

| | |
|---|---|
| ***H01R 13/66*** | (2006.01) |
| ***H01R 12/73*** | (2011.01) |
| *H01R 13/502* | (2006.01) |
| *H01R 12/71* | (2011.01) |

(52) U.S. Cl.

CPC ..... *H01R 13/6625* (2013.01); *H01R 12/73* (2013.01); *H01R 12/714* (2013.01); *H01R 13/502* (2013.01); *Y10T 29/4921* (2015.01)

(58) Field of Classification Search

USPC ..... 439/620.1, 83, 862, 607.05, 620.05, 439/620.06

See application file for complete search history.

(56) References Cited

U.S. PATENT DOCUMENTS 4,954,877 A * 9/1990 Nakanishi ..... H01L 23/49827 257/659
5,266,055 A * 11/1993 Naito ..... H01R 13/719 333/181
5,474,458 A * 12/1995 Vafi ..... H01L 23/49827 257/E23.063
5,854,534 A * 12/1998 Beilin ..... H01L 21/486 257/691
6,152,747 A * 11/2000 McNamara ..... H01R 23/688 439/108
6,239,386 B1 * 5/2001 DiStefano ..... H01R 13/2414 174/262
6,257,904 B1 * 7/2001 Lin ..... H05K 1/141 439/67
6,319,829 B1 * 11/2001 Pasco ..... H01L 23/49827 257/700
6,394,822 B1 * 5/2002 McNamara ..... H01R 23/688 439/108
6,672,912 B2 * 1/2004 Figueroa ..... H05K 1/0231 439/525
6,876,088 B2 * 4/2005 Harvey ..... H01L 25/0657 257/686
7,108,567 B1 * 9/2006 Korsunsky ..... H01R 12/7082 439/701
7,233,061 B1 * 6/2007 Conn ..... H01L 23/50 257/686
7,349,223 B2 * 3/2008 Haemer ..... G01R 1/07314 29/593
7,458,818 B2 * 12/2008 Kiyofuji ..... G01R 1/07371 324/750.07
7,850,488 B2 * 12/2010 Ikegami ..... H01R 13/6471 439/607.05
8,283,755 B2 * 10/2012 Hayasaka ..... H01L 21/76898 257/621
8,289,728 B2 * 10/2012 Koide ..... H01L 23/13 361/790
8,403,681 B2 * 3/2013 Chien ..... H01R 4/04 439/331
8,547,677 B2 * 10/2013 Anthony ..... H01G 4/005 361/118
8,587,915 B2 * 11/2013 Anthony ..... H01L 23/50 361/118
9,093,767 B2 * 7/2015 Rathburn ..... H05K 3/326

FOREIGN PATENT DOCUMENTS

JP 2008-227177 9/2008

* cited by examiner

*Primary Examiner* — Alexander Gilman
(74) *Attorney, Agent, or Firm* — Staas & Halsey LLP

(57) ABSTRACT

A connector includes: a housing; an insulating plate disposed within the housing; a first conductive film and a second conductive film which are disposed on a surface of the insulating plate to be insulated and spaced apart from each other; a capacitor embedded in the insulating plate; and a first via and a second via formed in the insulating plate to couple the first conductive film to the second conductive film by an alternating current through the capacitor.

12 Claims, 8 Drawing Sheets

CONNECTOR AND MANUFACTURING METHOD THEREOF

CROSS-REFERENCE TO RELATED APPLICATIONS

This application is based upon and claims the benefit of priority from the prior Japanese Patent Application No. 2013-179690 filed on Aug. 30, 2013, the entire contents of which are incorporated herein by reference.

FIELD

The present disclosure relates to a connector and a method of manufacturing the same.

BACKGROUND

In information devices such as, for example, a computer, various connectors are used so as to detachably connect electronic components. A connector is required to easily and reliably interconnect a plurality of terminals.

The information devices such as, for example, a computer have recently been remarkably developed, and a transmission rate of a signal between electronic components has been significantly increased. When the signal can be transmitted even more quickly in the future, the degradation of a signal waveform caused by a stub may be problematic. See, for example, Japanese Patent Laid-Open Publication No. 2008-227177.

SUMMARY

According to an aspect of the embodiments, a connector includes: a housing; an insulating plate disposed within the housing; a first conductive film and a second conductive film which are disposed on a surface of the insulating plate to be insulated and spaced apart from each other; a capacitor embedded in the insulating plate; and a first via and a second via formed in the insulating plate to couple the first conductive film to the second conductive film by an alternating current through the capacitor.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Hereinafter, prior to describing an exemplary embodiment, preliminary matters will be described in order to facilitate the understanding of the exemplary embodiment.

Figure 1:
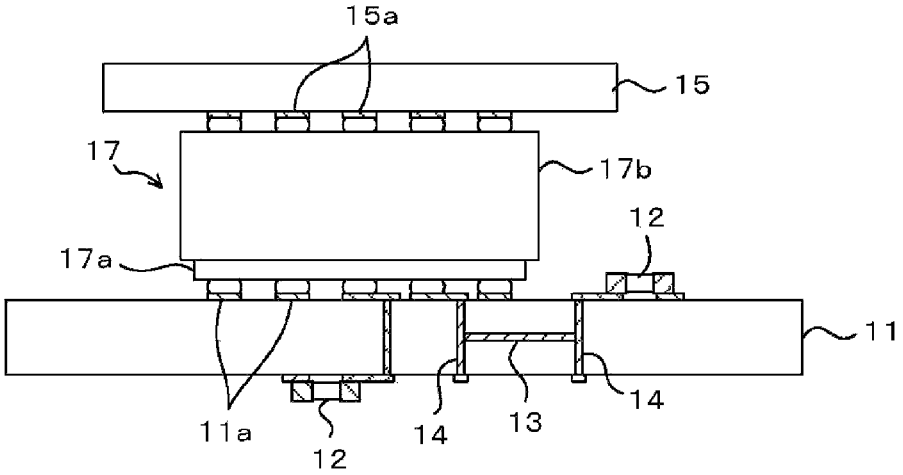
FIG. 1 is a schematic view illustrating an exemplary electronic device.
Figure 2:
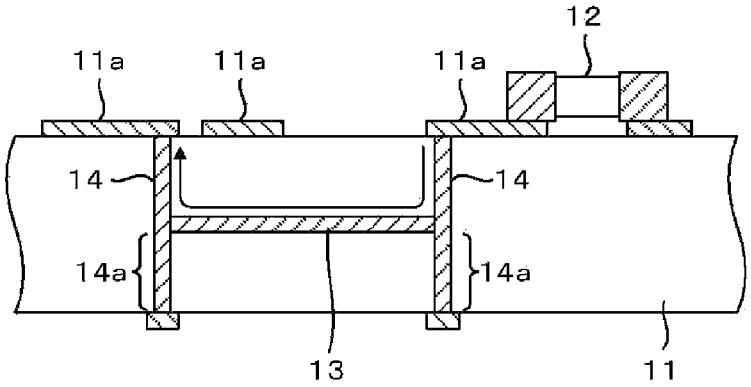
FIG. 2 is a schematic view illustrating a portion of FIG. 1 in an enlarged scale.

FIG. 1 is a schematic view illustrating an exemplary electronic device, and FIG. 2 is a schematic view illustrating a portion of FIG. 1 in an enlarged scale. In the electronic device illustrated in FIG. 1, a mother board 11 and a daughter board 15 are connected to each other via a connector 17.

The connector 17 is constituted by a header 17*a* and a receptacle 17*b* which are separable from each other. In the example illustrated in FIG. 1, the header 17*a* is soldered to electrodes 11*a* provided on the surface of the mother board 11, and the receptacle 17*b* is soldered to electrodes 15*a* provided on the surface of the daughter board 15.

Within the header 17*a* and the receptacle 17*b*, conductors are disposed forming a plurality of couples. When the header 17*a* is inserted into the receptacle 17*b*, the conductors within the header 17*a* come in contact with the conductors within the receptacle 17*b*. Accordingly, the wiring (not illustrated) of the mother board 11 is electrically connected to the wiring (not illustrated) of the daughter board 15 via the connector 17.

In the example illustrated in FIG. 1, a coupling capacitor 12 is mounted around the connector 17. The coupling capacitor 12 is electrically connected to the terminal of the connector 17 through an internal wiring 13 of the mother board 11 and vias 14 which penetrate the mother board 11 in a vertical direction.

A portion of a via 14 provided in the mother board 11 which is branched from a signal transmission path (indicated by the arrow in FIG. 2) is called a stub. The portion indicated by reference numeral 14*a* of FIG. 2 is the stub.

When the transmission rate of signal is low, the stub does not cause a problem. However, when the transmission rate of signal is increased to be, for example, in a range of 15 Gbps to 20 Gbps, the signal reflected from the stub 14*a* interferes with the signal which passes through the signal transmission path, thereby causing degradation in the waveform and a malfunction of an electronic device.

For example, when a portion to form a stub is removed through, for example, drilling, degradation in signal waveform caused by the stub may be avoided. However, in such a case, a complicated process such as drilling is required, thereby increasing a manufacturing cost.

In the exemplary embodiment to be described below, descriptions will be made on a connector which has a capacitor embedded therein to avoid degradation in signal waveform caused by a stub, and a method of manufacturing the same.

Exemplary Embodiment

Figure 3A:
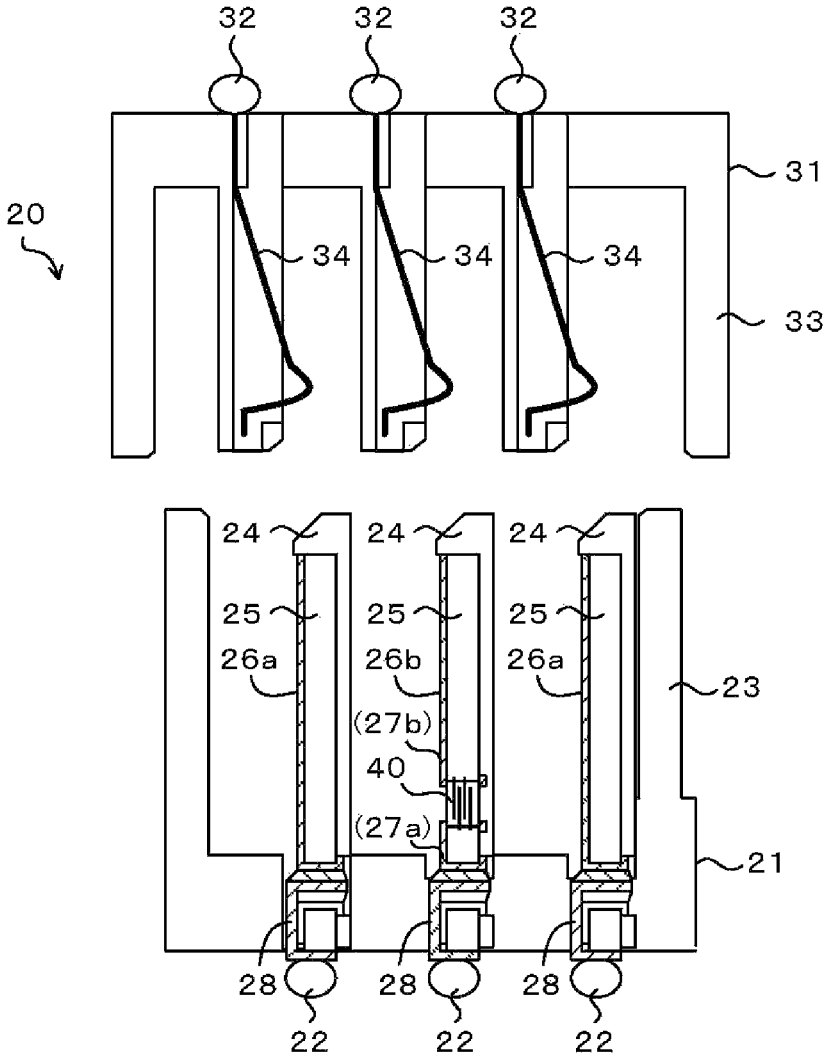
FIGS. 3A and 3B are schematic cross-sectional views illustrating the structure of a connector according to an exemplary embodiment of the present disclosure.
Figure 3B:
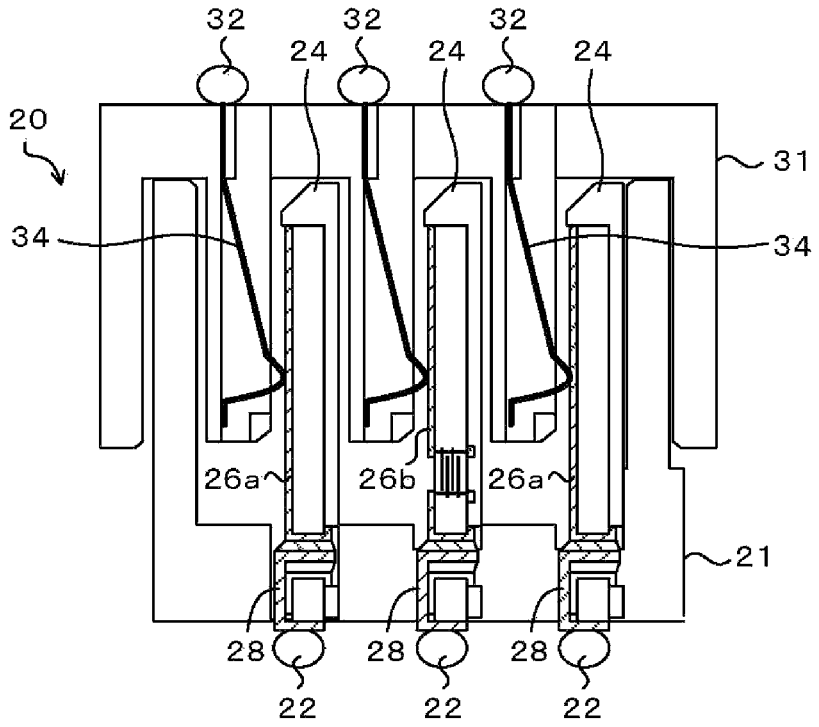
Figure 4:
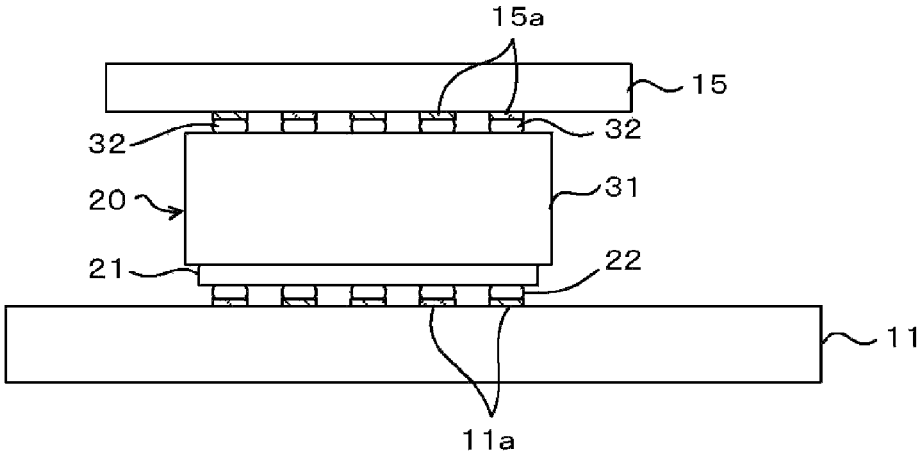
FIG. 4 is a schematic view illustrating an exemplary electronic device employing the connector according to the exemplary embodiment.
Figure 5:
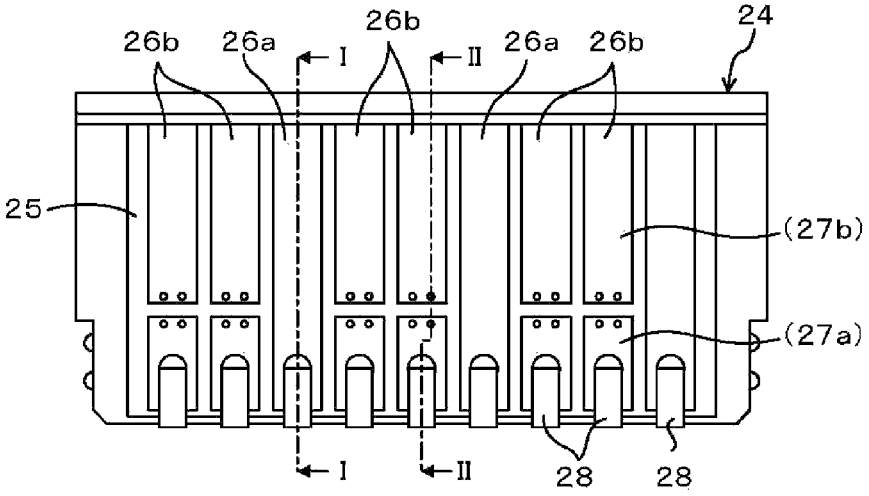
FIG. 5 is a plan view illustrating an exemplary blade provided within the connector.

FIGS. 3A and 3B are schematic cross-sectional views illustrating the structure of a connector according to the exemplary embodiment of the present disclosure, FIG. 4 is a schematic view illustrating an exemplary electronic device using the connector according to the exemplary embodiment of the present disclosure, and FIG. 5 is a plan view illustrating an exemplary blade provided within the connector.

In the exemplary embodiment, descriptions will be made on a case where a mezzanine connector is employed to detachably connect a mother board and a daughter board to each other.

As illustrated in FIG. 3A, a connector 20 is constituted by a header 21 and a receptacle 31 which are separable from each other. In the example illustrated in FIG. 4, the header 21 is connected to electrodes 11*a* of the mother board 11 through solders 22, and the receptacle 31 is connected to electrodes 15*a* of the daughter board 15 through solders 32.

The header 21 includes a box-shaped housing 23 made of, for example, an insulating resin, and thin plate-type members (hereinafter, referred to as "blades") 24 arranged at a predetermined pitch within the housing 23. A ceramic plate 25 is disposed on one side of each of the blades 24. On a surface of the ceramic plate 25, a plurality of connection pads 26*a* and 26*b* are arranged at a predetermined pitch in the width direction, as illustrated in FIG. 5.

In the example of FIG. 5, the connection pads 26*a* and 26*b* are arranged in the order of the connection pad 26*b*, the connection pad 26*b*, the connection pad 26*a*, the connection pad 26*b*, the connection pad 26*b*, the connection pad 26*a*, and so on from the left side. However, the number and the arrangement order of the connection pads 26*a* and 26*b* may be appropriately set as necessary.

Figure 6A:
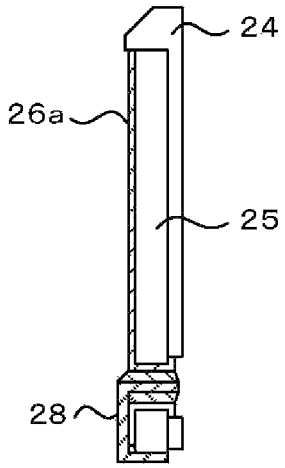
FIG. 6A is a cross-sectional view illustrating a connection pad at a position indicated by line I-I in FIG. 5.
Figure 6B:
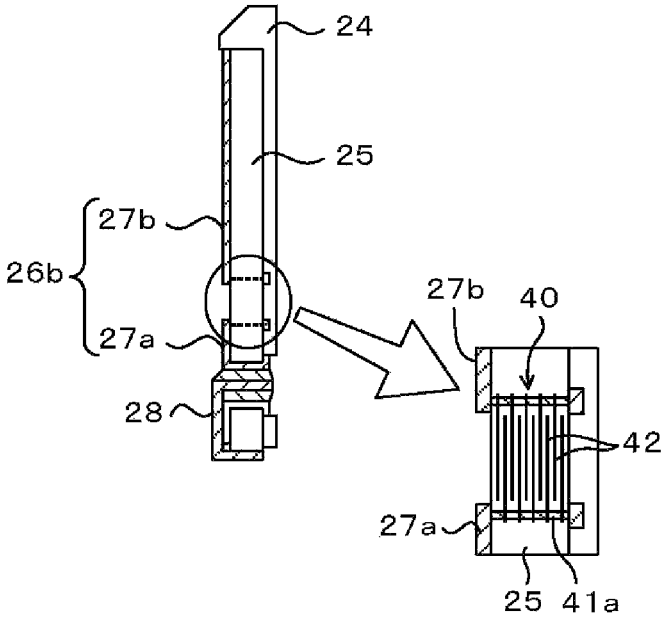
FIG. 6B is a cross-sectional view illustrating the connection pad at a position indicated by line II-II in FIG. 5.

FIG. 6A is a cross-sectional view illustrating a connection pad 26*a* at a position indicated by the line I-I of FIG. 5, and FIG. 6B is a cross-sectional view illustrating a connection pad 26*b* at a position indicated by the line II-II of FIG. 5.

The connection pad 26*a* is configured to simply electrically interconnect the wiring of the mother board 11 and the wiring of the daughter board 15, and as illustrated in FIGS. 5 and 6A, is constituted by a vertically elongated conductive film formed on the surface of the ceramic plate 25. The connection pad 26*a* is electrically connected to a lead 28 which is led to the outside of the housing 23, and a solder (solder ball) 22 is connected to an end of the lead 28 (see, e.g., FIGS. 3A and 3B).

The connection pad 26*b* is configured to interconnect the wiring of the mother board 11 and the wiring of the daughter board 15 through a capacitor. As illustrated in FIGS. 5 and 6B, the connection pad 26*b* includes a lower conductive film 27*a* and an upper conductive film 27*b* which are disposed to be spaced apart from each other in the vertical direction on the surface of the ceramic plate 25. A capacitor 40 is embedded in the ceramic plate 25 between the lower conductive film 27*a* and the upper conductive film 27*b*.

The capacitor 40 includes vias 41*a* and 41*b* which penetrate the ceramic plate 25. The capacitor 40 also includes a plurality of electrode plates 42 connected to the via 41*a*, and a plurality of electrode plates 42 connected to the via 41*b*. The electrode plates 42 connected to the via 41*a* and the electrode plates 42 connected to the via 41*b* are alternately arranged at a predetermined pitch in the thickness direction of the ceramic plate 25. The electrode plate 42 connected to the via 41*a* is an example of a first electrode plate, and the electrode plate 42 connected to the via 41*b* is an example of a second electrode plate.

The via 41*a* is electrically connected to the lower conductive film 27*a*, and the via 41*b* is electrically connected to the upper conductive film 27*b*. The lower conductive film 27*a* is electrically connected to a lead 28 which is led to the outside of the housing 23. A solder (solder ball) 22 is connected to the end of the lead 28 (see, e.g., FIGS. 3A and 3B).

As illustrated in FIGS. 3A and 3B, the receptacle 31 includes a housing 33 made of, for example, an insulating resin, and a plurality of thin-plate type contact electrodes (metallic plates) 34 disposed within the housing 33. Each of the contact electrodes 34 is bent in a predetermined shape to have a spring property. The front end portion of the contact electrode 34 is curved to come in contact with the connection pads 26*a* and 26*b* of the header 21, and the rear end portion is led to the outside of the housing 33. A solder (solder ball) 32 is connected to the rear end portion of the contact electrode 34.

In the connector 20 configured according to the present exemplary embodiment as described above, when the header 21 is inserted into the receptacle 31 as illustrated in FIG. 4, the front end portion of the contact electrode 34 comes in contact with the connection pads 26*a* and 26*b* of the blade 24 as illustrated in FIG. 3B. Then, the wiring (not illustrated) of the mother board 11 and the wiring (not illustrated) of the daughter board 15 are electrically connected to each other through the connector 20.

As described above, the connector 20 according to the present exemplary embodiment includes a capacitor 40 embedded therein. The capacitor 40 embedded in the connector 20 may be used as, for example, a coupling capacitor or a decoupling capacitor.

When the capacitor 40 embedded in the connector 20 is used as the coupling capacitor or the decoupling capacitor, it is not necessary to mount a coupling capacitor or a decoupling capacitor in the mother board 11 or the daughter board 15. This may simplify a signal transmission path of a wiring substrate (the mother board 11), and the wiring which becomes a stub may be eliminated. As a result, it is possible to avoid degradation in signal waveform caused by the stub, thereby avoiding malfunction of an electronic device.

Hereinafter, a method of manufacturing a ceramic plate 25 disposed within a connector 20 will be described with reference to FIGS. 7A to 7C and FIGS. 8A to 8C.

Figure 7A:
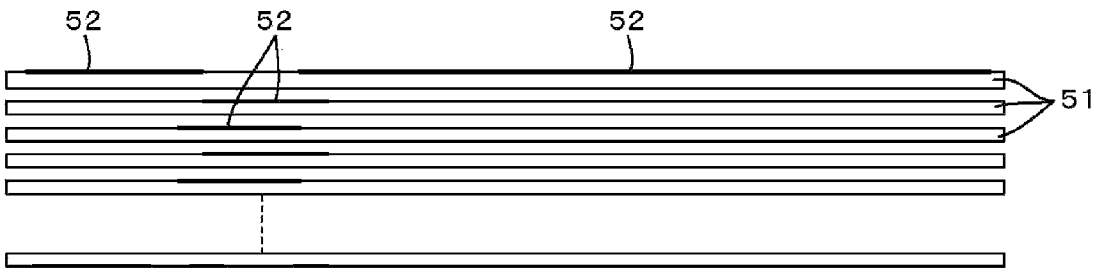
FIGS. 7A, 7B, and 7C are views illustrating a method of manufacturing a ceramic plate disposed within a connector (a first process).

As illustrated in FIG. 7A, a plurality of green sheets (ceramic sheets before baking) 51 are prepared first. The thickness of each of the green sheets 51 is, for example, about 50 μm. The green sheets 51 are an example of insulating sheets.

Subsequently, a conductive paste 52 is applied on the surfaces of the green sheets 51 by a printing method in a desired pattern (e.g., patterns of lower conductive films 27*a*, upper conductive films 27*b* and electrode plates 42). As for the conductive paste 52, for example, nickel (Ni) paste may be used. The application thickness of the conductive paste 52 may range from 20 μm to 30 μm.

Figure 7B:
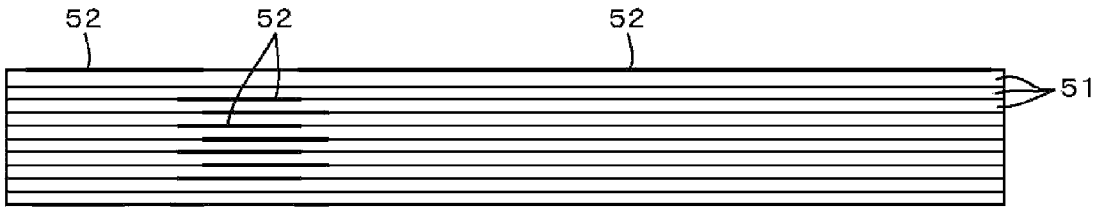
Figure 7C:
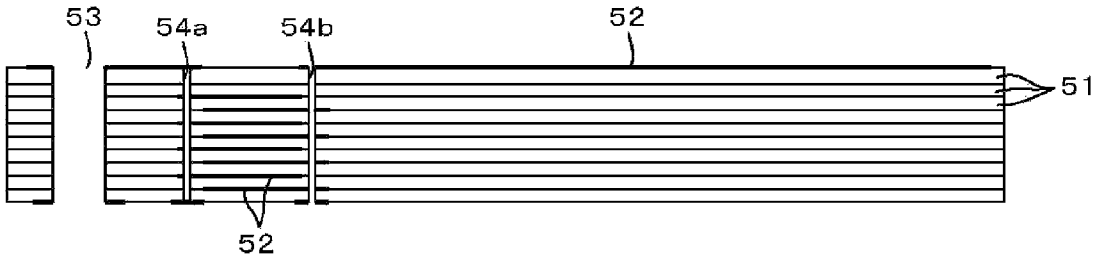

As illustrated in FIG. 7B, the green sheets 51 applied with the conductive paste 52 are laminated to form a laminated body. By using, for example, a drill, as illustrated in FIG. 7C, a through hole 53 and through holes 54*a* and 54*b* are formed in the laminated body of the green sheets 51. The through hole 53 is provided for attaching a lead 28, and the through holes 54*a* and 54*b* are for forming vias 41*a* and 41*b*.

Figure 8A:
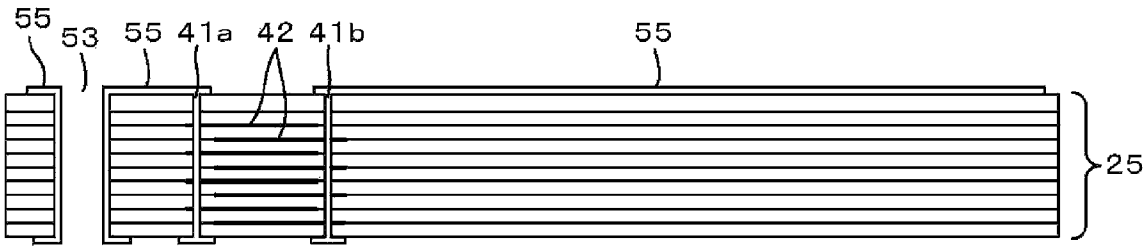
FIGS. 8A, 8B, and 8C are views illustrating a manufacturing method of a ceramic plate disposed within a connector (a second process).

Then, the laminated body of the green sheets 51 is baked in a baking furnace, for example, at a temperature ranging from 1000° C. to 1300° C. to be transformed into a ceramic plate 25 as illustrated in FIG. 8A. The thickness of the ceramic plate 25 after baking is, for example, 0.5 mm.

A copper (Cu) plating is performed on the top of the conductive paste 52 adhered on the surface of the ceramic plate 25, and on the wall surfaces of the through hole 53 and the through holes 54*a* and 54*b* so as to form a copper plated layer 55. The thickness of the copper plated layer 55 is, for example, 1 μm.

Here, a via 41*a* is formed by the copper adhered within the through hole 54*a*, and a via 41*b* is formed by the copper adhered within the through hole 54*b*. The conductive paste 52 buried in the ceramic plate 25 becomes electrode plates 42 (see, e.g., FIG. 6B).

Figure 8B:
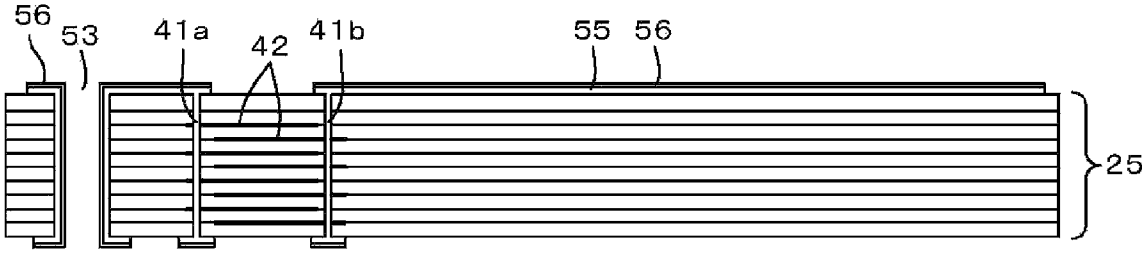

Subsequently, as illustrated in FIG. 8B, a nickel plating is performed on the copper plated layer 55 so as to form a nickel plated layer 56. The thickness of the nickel plated layer 56 is, for example, 2 μm.

Figure 8C:
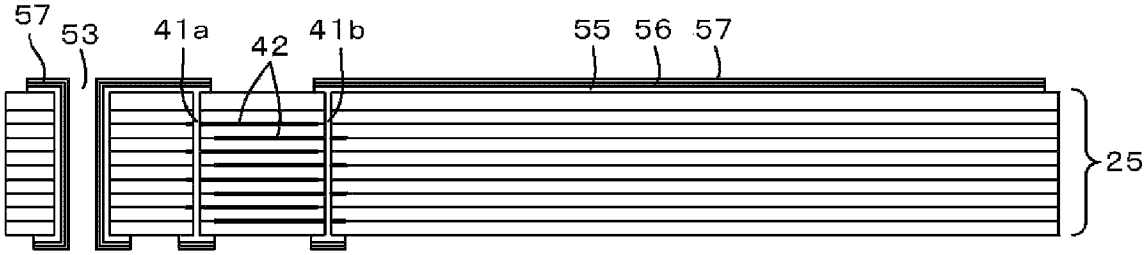

Subsequently, as illustrated in FIG. 8C, a gold (Au) plating is performed on the nickel plated layer 56 so as to form a gold plated layer 57. The thickness of the gold plated layer 57 is, for example, 0.6 μm.

The ceramic plate 25 manufactured as described above is attached to a blade housing made of an insulating material such as, for example, a liquid crystal polymer (LCP) or polyphenylene sulphide (PPS) so as to form a blade 24 as illustrated in FIG. 5. A predetermined number of blades 24 are disposed within the housing 23, as illustrated in FIG. 3A. In this manner, a header 21 is completed.

According to the present exemplary embodiment, when the size and the number of layers of the electrode plates 42, and the thickness of the green sheets 51 are properly selected, a capacitor 40 may be manufactured with a desired capacity.

Figure 9:
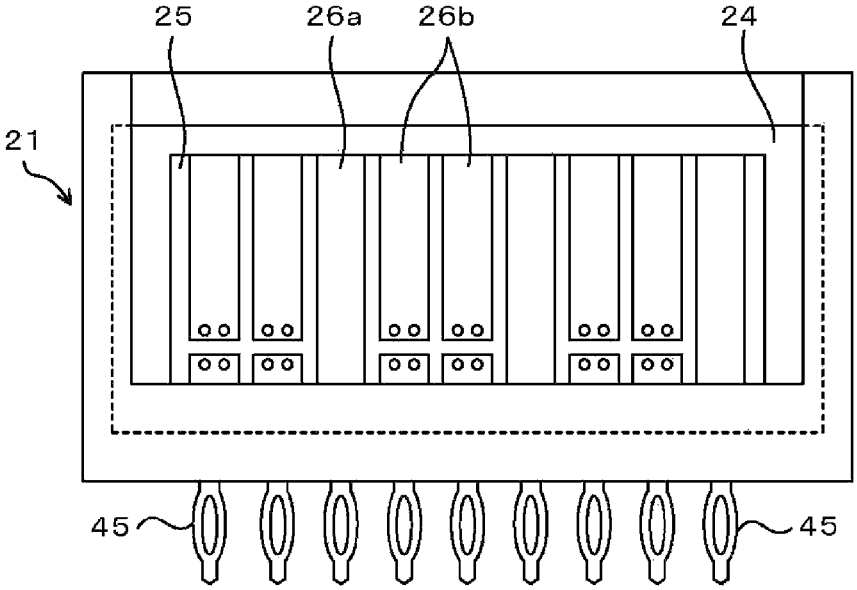
FIG. 9 is a schematic plan view illustrating a connector provided with a press fit terminal.

In the present exemplary embodiment, the descriptions have been made on a surface-mountable connector that is mounted on a substrate surface by solder balls provided at the ends of the leads 28. However, the technology of the present disclosure may be applied to a connector provided with a press fit terminal 45 as illustrated in FIG. 9.

When the press fit terminal 45 is press-fitted into the hole of a wiring substrate (an electronic component), a relatively large pressure is applied to the blade 24. However, since the capacitor 40 is embedded in the ceramic plate 25, the pressure applied to the press fit terminal 45 is not directly applied to the capacitor 40. Accordingly, the capacitor 40 may not be damaged by the pressure when the press fit terminal 45 is press-fitted into the hole of the wiring substrate.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present invention has (have) been described in detail, it should be understood that the various changes, substitutions, and alterations could be made hereto without departing from the spirit and scope of the invention.

What is claimed is:

1. A connector, comprising:

a housing;

an insulating plate disposed within the housing;

a first conductive film and a second conductive film disposed in such a manner that the first conductive film is in contact with a first longitudinal surface of the insulating plate at a first area, the second conductive film is in contact with the first longitudinal surface at a second area different from the first area and a non-contact surface of the first longitudinal surface where the first conductive film and the second conductive film are not in contact with the first longitudinal surface is provided between the first area and the second area;

a capacitor embedded in a portion of the insulating plate corresponding to the non-contact surface; and a first via and a second via formed in the insulating plate to couple the first conductive film to the second conductive film by an alternating current through the capacitor.

2. The connector of claim 1, wherein the capacitor includes a plurality of first electrode plates connected to the first via, and a plurality of second electrode plates connected to the second via, and the first electrode plates and the second electrode plates are alternately arranged in a thickness direction of the insulating plate.

3. The connector of claim 1, wherein the insulating plate is made of a ceramic.

4. The connector of claim 1, further comprising a lead which is electrically connected to the first conductive film and led to an outside of the housing.

5. The connector of claim 1, further comprising a press fit terminal which is electrically connected to the first conductive film and led to an outside of the housing to be press-fitted into a hole of an electronic component.

6. The connector of claim 1, wherein the first via passes through the insulating plate in a longitudinal direction toward the first conductive film, and the second via passes through the insulating plate in the longitudinal direction toward the second conductive film.

7. The connector of claim 1, wherein the capacitor is embedded between the first via and the second via.

8. The connector of claim 1, further comprising:

a blade configured to be in contact with a second longitudinal surface of the insulating plate which is opposite to the first longitudinal surface and a first short-direction surface of the insulating plate on the side of the second conductive film.

9. The connector of claim 1, wherein the first conductive film is in contact with a second short-surface of the insulating plate on the side of the first conductive film.

10. A method of manufacturing a connector, comprising:

laminating a plurality of insulating sheets to form a laminated body;

forming a first conductive film and a second conductive film in such a manner that the first conductive film is in contact with a first longitudinal surface of the laminated body at a first area, the second conductive film is in contact with the first longitudinal surface at a second area different from the first area and a non-contact surface of the first longitudinal surface where the first conductive film and the second conductive film are not in contact with the first longitudinal surface is provided between the first area and the second area;

forming a first group of conductive patterns and a second group of conductive patterns in a portion of the laminated body corresponding to the non-contact surface to form first electrodes and second electrodes of a capacitor;

forming a first hole to be connected to the first group of conductive patterns and a second hole to be connected to the second group of conductive patterns in the laminated body; and adhering a conductor on wall surfaces of the first hole and the second hole to form a first via which electrically interconnects the first group of conductive patterns and a second via which electrically interconnects the second group of conductive patterns.

11. The method of claim 10, wherein the insulating sheets are ceramic sheets.

12. The method of claim 10, wherein a conductive paste is applied on surfaces of the plurality of insulating sheets in the portion of the laminated body corresponding to the non-contact surface to form the first group of conductive patterns and the second group of conductive patterns.

* * * * *